US007930057B2

(12) United States Patent
Hayakawa et al.

(10) Patent No.: US 7,930,057 B2
(45) Date of Patent: Apr. 19, 2011

(54) EMBROIDERY DATA PROCESSING APPARATUS, EMBROIDERY DATA PROCESSING PROGRAM RECORDED ON COMPUTER-READABLE RECORDING MEDIUM, AND SEWING MACHINE

(75) Inventors: Atsuya Hayakawa, Chita (JP); Masayuki Hori, Gifu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 955 days.

(21) Appl. No.: 11/822,512

(22) Filed: Jul. 6, 2007

(65) Prior Publication Data

US 2008/0021588 A1 Jan. 24, 2008

(30) Foreign Application Priority Data

Jul. 18, 2006 (JP) ..... 2006-196116

(51) Int. Cl.
*D05C 5/02* (2006.01)

(52) U.S. Cl. ..... 700/138; 112/475.19; 112/102.5

(58) Field of Classification Search ..... 700/136, 700/137, 138; 112/470.06, 470.19, 475.06, 112/475.19, 102.5
See application file for complete search history.

(56) References Cited

U.S. PATENT DOCUMENTS 4,227,472 A * 10/1980 Bergvall ..... 112/456
4,352,334 A * 10/1982 Childs et al. ..... 112/475.19
4,720,795 A * 1/1988 Kinoshita et al. ..... 700/137
4,869,188 A * 9/1989 Hyodo ..... 112/445
4,919,062 A * 4/1990 Yokoe et al. ..... 112/470.04
5,592,891 A * 1/1997 Muto ..... 112/475.19
5,648,908 A * 7/1997 Chirn et al. ..... 700/135
5,771,173 A * 6/1998 Tsonis et al. ..... 700/131
5,865,134 A * 2/1999 Okuyama et al. ..... 112/102.5
5,867,391 A * 2/1999 Muto ..... 700/137
5,964,168 A * 10/1999 Komuro ..... 112/102.5
6,012,402 A * 1/2000 Sekine ..... 112/102.5
6,123,040 A * 9/2000 Hayakawa et al. ..... 112/445
6,173,665 B1 * 1/2001 Sekine ..... 112/102.5
6,836,695 B1 * 12/2004 Goldman ..... 700/137
RE38,718 E * 3/2005 Futamura ..... 700/138
6,947,808 B2 * 9/2005 Goldman ..... 700/138
6,980,877 B1 * 12/2005 Hagino et al. ..... 700/138
7,016,756 B2 * 3/2006 Goldman ..... 700/138
7,016,757 B2 * 3/2006 Goldman ..... 700/138
7,055,443 B2 * 6/2006 Goto et al. ..... 112/102.5
7,457,683 B2 * 11/2008 Bailie ..... 700/138
7,587,256 B2 * 9/2009 Goldman ..... 700/138

(Continued)

FOREIGN PATENT DOCUMENTS

JP A-2004-033538 2/2004

*Primary Examiner* — Danny Worrell
(74) *Attorney, Agent, or Firm* — Oliff & Berridge, PLC

(57) ABSTRACT

When a user specifies, as an embroidery sewing condition, an embroidery pattern that can be sewn with thread spools set for needle bars, embroidery data on an embroidery pattern and needle bar thread information on a thread set for a needle bar are read and stored in a RAM. Embroidery thread information included in embroidery data is read out in a sequential order, and embroidery thread information and specified thread information are compared with each other. An embroidery pattern having embroidery data of which all of the embroidery thread information is coincident with the specified thread information is extracted as an embroidery pattern that satisfies the embroidery sewing condition. The extracted embroidery pattern is then displayed on a liquid crystal display.

21 Claims, 13 Drawing Sheets

U.S. PATENT DOCUMENTS

2002/0038162 A1* 3/2002 Yamada ..... 700/138
2005/0178306 A1* 8/2005 Hagino ..... 112/102.5
2005/0182508 A1* 8/2005 Niimi et al. ..... 700/138
2005/0188906 A1* 9/2005 Goto et al. ..... 112/102.5
2005/0283268 A1* 12/2005 Hagino et al. ..... 700/138

* cited by examiner

FIG. 7

| SEQUENTIAL ORDER | EMBROIDERY PATTERN 1 | EMBROIDERY PATTERN 2 | EMBROIDERY PATTERN 3 | EMBROIDERY PATTERN 4 | EMBROIDERY PATTERN 5 |
|---|---|---|---|---|---|
| 1 | LIGHT BLUE | YELLOW GREEN | GREEN | RED | SKY BLUE |
| 2 | YELLOW GREEN | RED | LIGHT BLUE | LIGHT BLUE | BLACK |
| 3 | PURPLE | PURPLE | PURPLE | GREEN | LIGHT BLUE |
| 4 | GREEN | DEEP GREEN | GOLD | PURPLE | PINK |
| 5 | LIGHT BLUE | SKY BLUE | LIGHT BLUE | YELLOW GREEN | BLUE |
| 6 | | GOLD | PINK | GREEN | BROWN |

FIG. 8

| NEEDLE BAR NUMBER | THREAD COLOR |
|---|---|
| 1 | YELLOW GREEN |
| 2 | PURPLE |
| 3 | LIGHT BLUE |
| 4 | RED |
| 5 | GOLD |
| 6 | GREEN |

EMBROIDERY DATA PROCESSING APPARATUS, EMBROIDERY DATA PROCESSING PROGRAM RECORDED ON COMPUTER-READABLE RECORDING MEDIUM, AND SEWING MACHINE

CROSS-REFERENCE TO RELATED APPLICATION

This Application claims priority from Japanese Patent Application No. 2006-196116 filed Jul. 18, 2006, the disclosure of which is hereby incorporated by reference herein in its entirety.

BACKGROUND

The present disclosure relates to an embroidery data processing apparatus, an embroidery data processing program recorded on a computer-readable recording medium, and a sewing machine. Specifically, the present disclosure relates to an embroidery data processing apparatus, an embroidery data processing program, and a sewing machine for extracting an embroidery pattern to be sewn by a sewing machine.

A conventional sewing machine is capable of sewing an embroidery pattern. In such a sewing machine, a desired embroidery pattern is selected by a user from among a plurality of embroidery patterns stored in a storage device (internal memory) of the sewing machine or in an external memory such as a ROM card or a memory disk. The sewing machine reads embroidery data on a selected embroidery pattern, and then sews the embroidery pattern on a work cloth while an embroidery frame for holding the work cloth is moved and driven by a frame drive mechanism.

There is a demand for efficiently sewing a desired embroidery pattern by such a sewing machine, and there have been proposed a variety of embroidery data creation apparatus or sewing machines having achieved efficient sewing of an embroidery pattern. For example, there has been proposed a sewing machine control apparatus, a sewing machine control method and a sewing machine control program, in which if an embroidery pattern is sewn by a multi-needle type embroidery sewing machine that has a plurality of needle bars, a relationship is defined between each needle bar and a thread supplied to a sewing needle set at each needle bar in consideration of sequential sewing orders, a frequency of thread use or the like so that the thread replacement count during embroidery sewing is reduced, and appropriate action is announced to a user (see Japanese Patent Application Laid-open No. 2004-33538, for example).

The conventional sewing machine control apparatus described above is intended to efficiently sew an embroidery pattern selected by a user by reducing the thread replacement count required during sewing the embroidery pattern. However, the conventional apparatus fails to efficiently select an embroidery pattern suitable for sewing with threads possessed by a user, or sewing with threads of specific colors. Therefore, in order to obtain an embroidery pattern under the conditions set forth above, embroidery data on each embroidery pattern must be verified by reading out the data, thereby requiring a large amount of time and effort.

SUMMARY

It is an object of the present disclosure to provide an embroidery data processing apparatus, an embroidery data processing program recorded on a computer-readable recording medium, and a sewing machine that are capable of efficiently extracting an embroidery pattern of a desired sewing condition.

According to one example, there is provided an embroidery data processing apparatus that includes data storage device that stores embroidery data on a plurality of embroidery patterns to be sewn by a sewing machine. The apparatus also includes a condition specification device that specifies an embroidery sewing condition for sewing the embroidery pattern, and an embroidery pattern extraction device that compares the embroidery data stored in the data storage device with the embroidery sewing condition specified by the condition specification device and that extracts an embroidery pattern having the data satisfying the embroidery sewing condition.

According to another example, there is provided an embroidery data processing program recorded on a computer-readable recording medium. The program causes a controller to perform a step of acquiring embroidery data on a plurality of embroidery patterns to be sewn by a sewing machine, a step of acquiring an embroidery sewing condition for sewing the embroidery pattern, and a step of comparing the acquired embroidery data with the acquired embroidery sewing condition so as to extract the embroidery pattern having the embroidery data that satisfies the embroidery sewing condition.

According to a further example, there is provided a sewing machine including a data storage device that stores embroidery data on a plurality of embroidery patterns, a specification device that specifies an embroidery sewing condition for sewing the embroidery pattern, and an embroidery pattern extraction device that compares the embroidery data stored in the data storage device with the embroidery sewing condition specified by the specification device and that extracts the embroidery pattern having the embroidery data satisfying the embroidery sewing condition.

BRIEF DESCRIPTION OF THE DRAWINGS

Exemplary embodiments will be described below in detail with reference to the accompanying drawings in which:

FIG. 7 is a table including embroidery patterns stored in a ROM;

FIG. 8 is a table including needle bar thread information on threads set at needle bars of a multi-needle embroidery sewing machine;

DETAILED DESCRIPTION

First and second embodiments will be described with reference to the accompanying drawings. An embroidery data processing apparatus according to the first embodiment is intended to extract an embroidery pattern to be sewn by a multi-needle embroidery sewing machine 11 equipped with six needle bars. That is, the sewing machine 11 is capable of carrying out embroidery sewing with six types of threads supplied from thread spools to sewing needles attached to the needle bars. The apparatus is provided integrally with the multi-needle type embroidery sewing machine 11. Alternatively, the embroidery data processing apparatus may be provided separately from a sewing machine.

Figure 1:
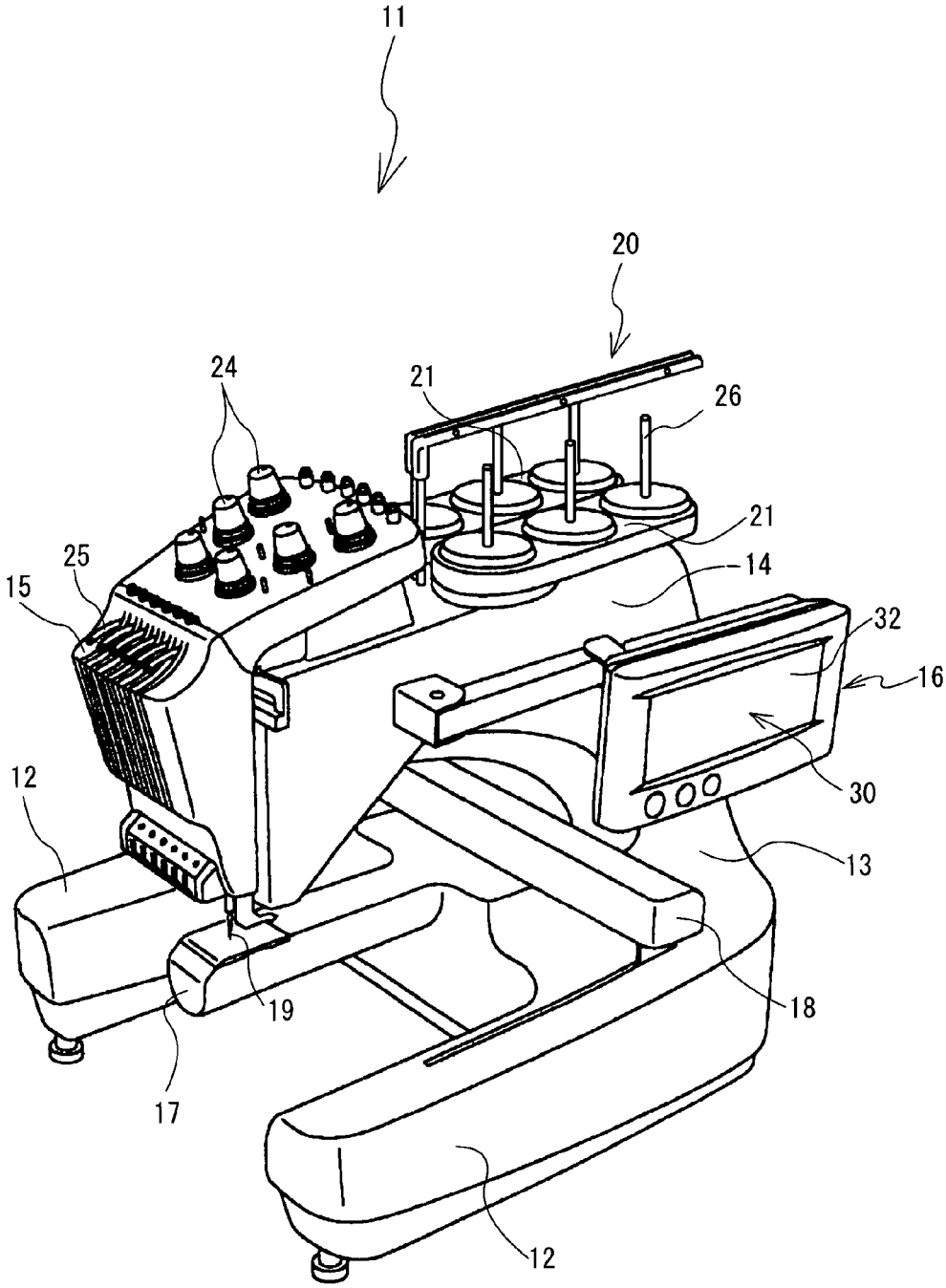
FIG. 1 is a perspective view of a multi-needle type embroidery sewing machine when a thread spool base is set at a storage position.
Figure 2:
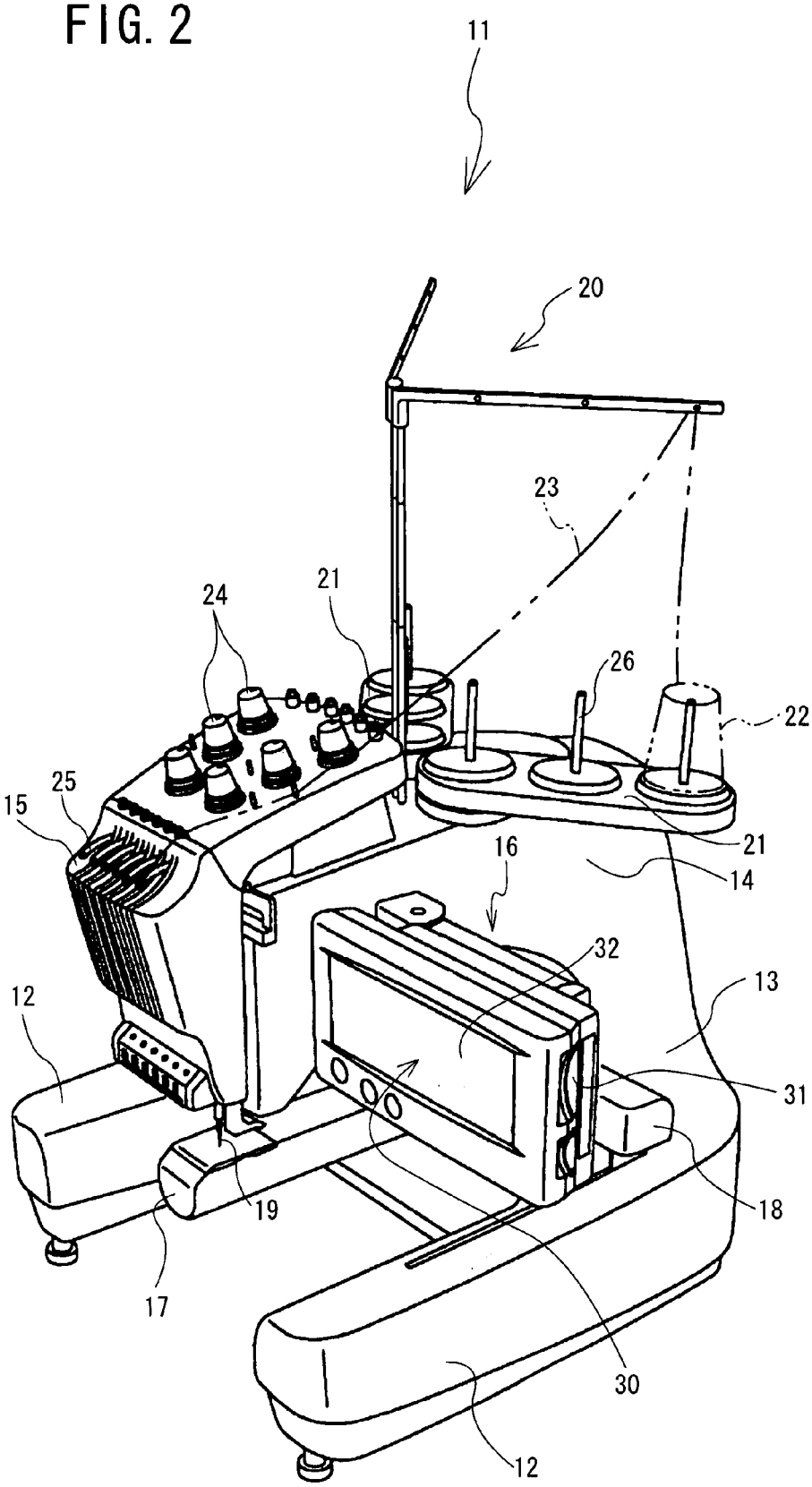
FIG. 2 is a perspective view of a multi-needle type embroidery sewing machine when a thread spool base is set at an operating position.
Figure 3:
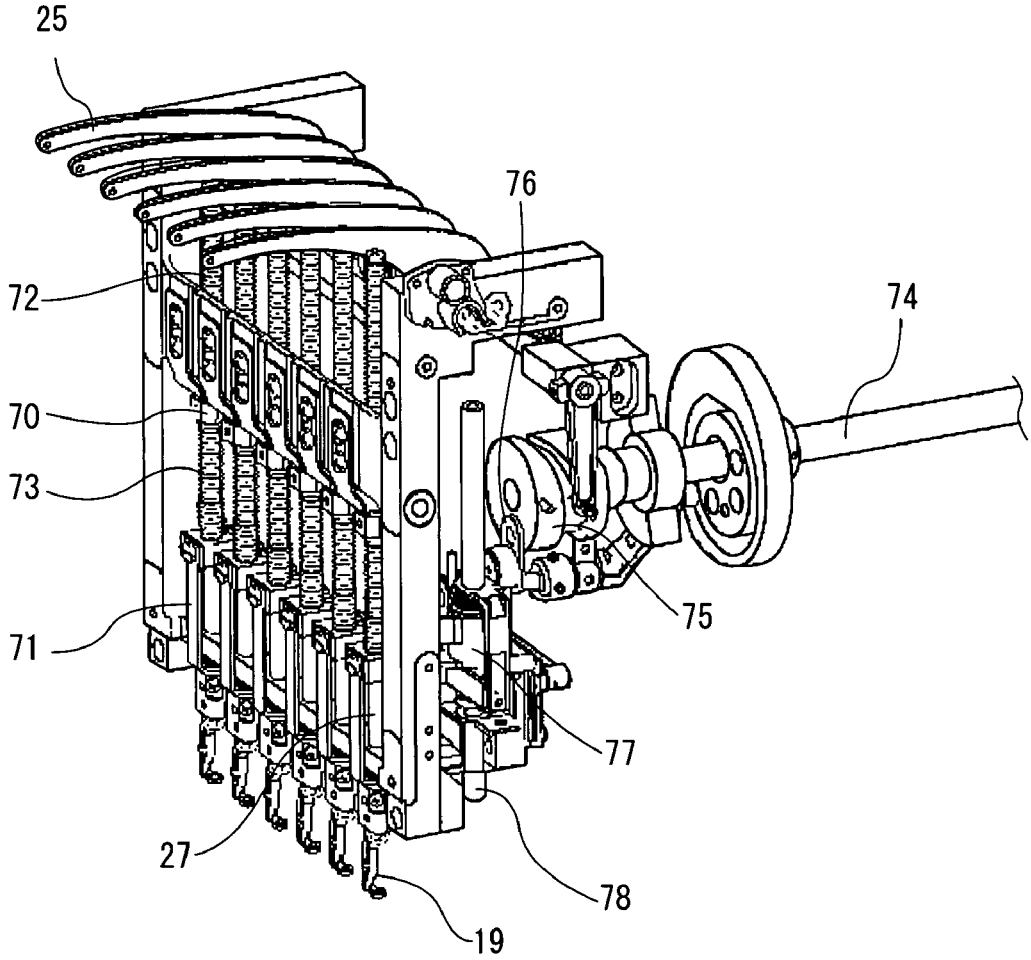
FIG. 3 is a perspective view showing an internal configuration of a needle bar case of a multi-needle type embroidery sewing machine.

A physical configuration of a multi-needle type embroidery sewing machine 11 and an embroidery data processing apparatus provided in the sewing machine 11 will be described with reference to FIG. 1 to FIG. 3. In the following description, the front side of the paper face of FIG. 1 or FIG. 2 is referred to as a "front side of the multi-needle type embroidery machine 11", while the rear side of the paper face is referred to as "rear side of the multi-needle type embroidery sewing machine 11". In addition, the transverse direction viewed from a user is referred to as a transverse direction of the multi-needle type embroidery machine 11.

As shown in FIGS. 1 and 2, the multi-needle type embroidery sewing machine 11 is equipped with a support portion 12, a pillar 13 that extends upwardly from the support portion 12, an arm portion 14 that extends from an upper end of the pillar 13 to the front of the multi-needle sewing machine 11, and a needle bar case 15 mounted on an end of the arm portion 14 so as to be movable in the transverse direction. In addition, an operating portion 16 is pivotally connected to the right side of the center part of the arm portion 14, and is capable of switching between a storage position shown in FIG. 1 and an operating position shown in FIG. 2. A cylinder head portion 17 extends from a lower end part of the pillar 13 to the front of the sewing machine 11 below the arm portion 14. A bar-shaped embroidery frame moving mechanism 18 also is provided at the lower end part of the pillar 13, extending in the transverse direction.

Thread spool bases 21 provided at a back part of a top face of the arm portion 14 will be described with reference to FIGS. 1 and 2. As shown in FIGS. 1 and 2, a pair of left and right thread spool bases 21, to which a plurality of thread spools 22 can be mounted, are provided at the rear side of a top face of the arm portion 14. In addition, a thread guide mechanism 20 is provided so as to correspond to the thread spool bases 21. The thread spool bases 21 and the thread guide mechanism 20 are configured so that they can be switched between a storage position retracted in a direction substantially parallel to a longitudinal direction of the multi-needle embroidery sewing machine 11, as shown in FIG. 1, and an operating position that opens away from a rear end of the multi-needle type embroidery sewing machine 11, as shown in FIG. 2. Three thread spool pins 26 onto which the thread spools 22 are engaged are provided on each of the thread spool bases 21. Accordingly, a total of six thread spools 22, equal to the number of sewing needles 19, can be placed on the pair of the left and right thread spool bases 21. An upper thread 23 extending from each of the thread spools 22 set on the thread spool bases 21 is supplied to each of the sewing needles 19 via (1) the thread guide mechanism 20 that prevents tangling of the upper thread 23, (2) a tensioner 24 that adjusts a tension of the thread, and (3) a thread take-up lever 25 for pulling up the upper thread while vertically reciprocating.

A description of the internal configuration of a needle bar case 15 will be given with reference to FIG. 3. As shown in FIG. 3, six needle bars 27 are provided in the needle bar case 15. A sewing needle 19 is provided at a lower end of each of the needle bars 27. Each needle bar 27 is slidably supported in a vertical direction by two upper and lower fixing members each fixed to a frame of the needle bar case 15. In FIG. 3, only the upper fixing member 70 is shown. In addition, a presser foot 71 that is slidable in a vertical direction is provided at a lower end of the needle bar 27. A first presser spring 72 is provided at an upper portion of the needle bar 27, and a second presser spring 73 is provided at a lower portion of the needle bar 27, respectively.

Referring to FIGS. 1 and 2, a description will be given with respect to the operating portion 16 pivotally supported by the arm portion 14. At the operating portion 16, there are provided a liquid crystal display 30 that displays thread information, an embroidery pattern or the like, and a floppy disk drive (hereinafter, referred to as "FDD") 31 into which a floppy disk (not shown) is to be inserted. That is, the liquid crystal display 30 displays thread information on threads set for the needle bars 27 (refer to FIGS. 3 and 4), embroidery data of an embroidery pattern, needle bar number and thread information corresponding to the needle bar 27 for which the thread is to be replaced, names of functions that execute a variety of procedures for embroidery sewing, a variety of messages and the like. A touch panel 32 is provided on a front face of the liquid crystal display 30. Various commands displayed on the liquid crystal display 30 can be selected with a finger or a dedicated touch pen sensed by the touch panel 32.

A description will be given with respect to an operation of forming stitches on a work cloth mounted on an embroidery frame (not shown) supported on the embroidery frame moving mechanism 18 (refer to FIG. 2). First, a needle bar case 15 moves transversely, whereby one of the six needle bars 27 is selected. Then, a drive shaft 74 (refer to FIG. 3) is rotationally driven by a sewing machine motor 54 (refer to FIG. 4), and its rotational drive is transmitted to a coupling member 76 via a thread take-up drive cam 75. As a result, a transmission member 77 pivotally connected to the coupling member 76 is driven vertically while being guided by a guide bar 78 disposed horizontally of the needle bar 27. The vertical drive of the transmission member 77 is transmitted to the needle bar 27 via a coupling pin (not shown), and the needle bar 27 is driven vertically together with the sewing needle 19. The needle bar 27 is thus driven vertically, whereby stitches are formed on the work cloth.

Figure 4:
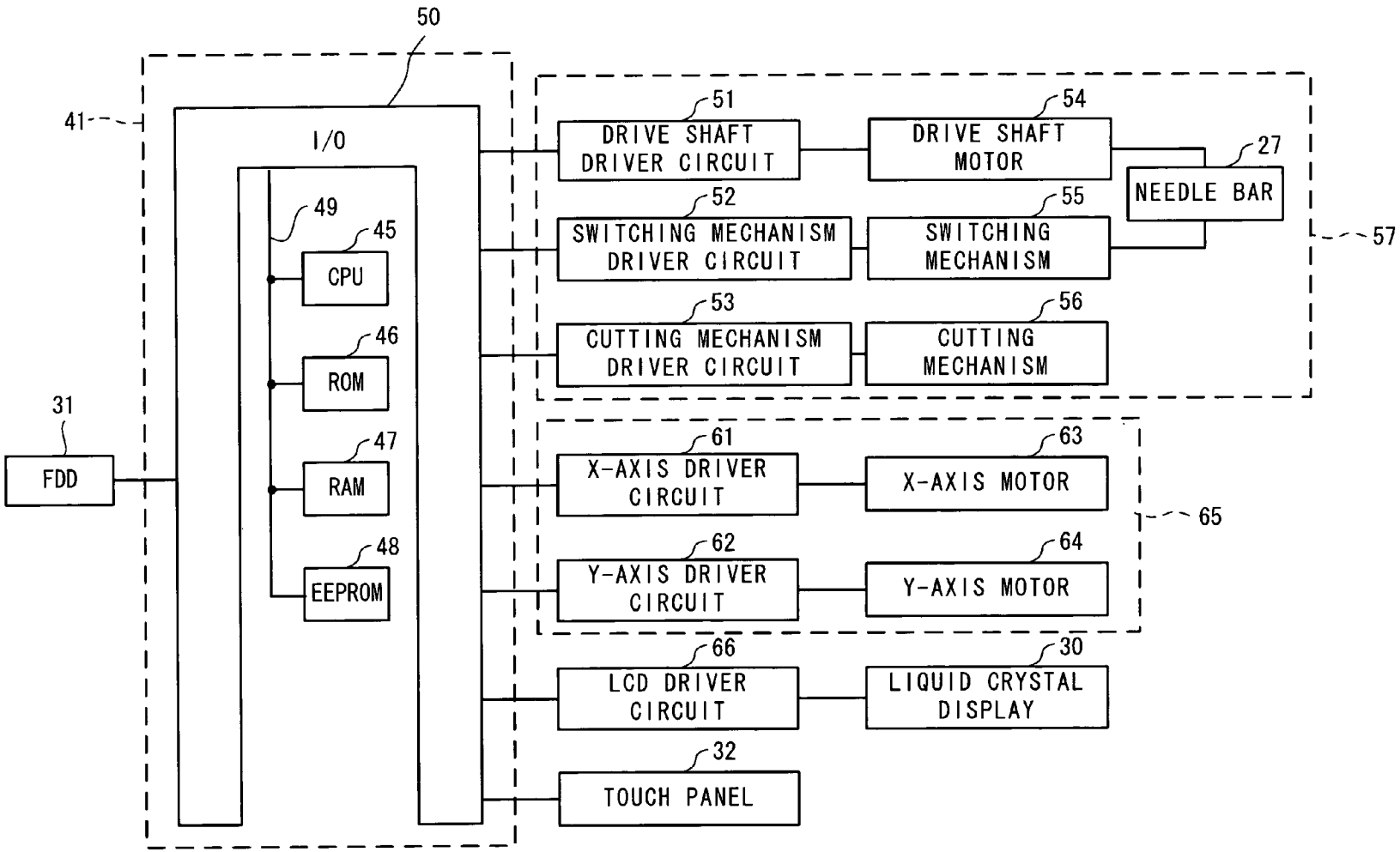
FIG. 4 is a block diagram depicting an electrical configuration of a multi-needle embroidery sewing machine.
Figure 5:
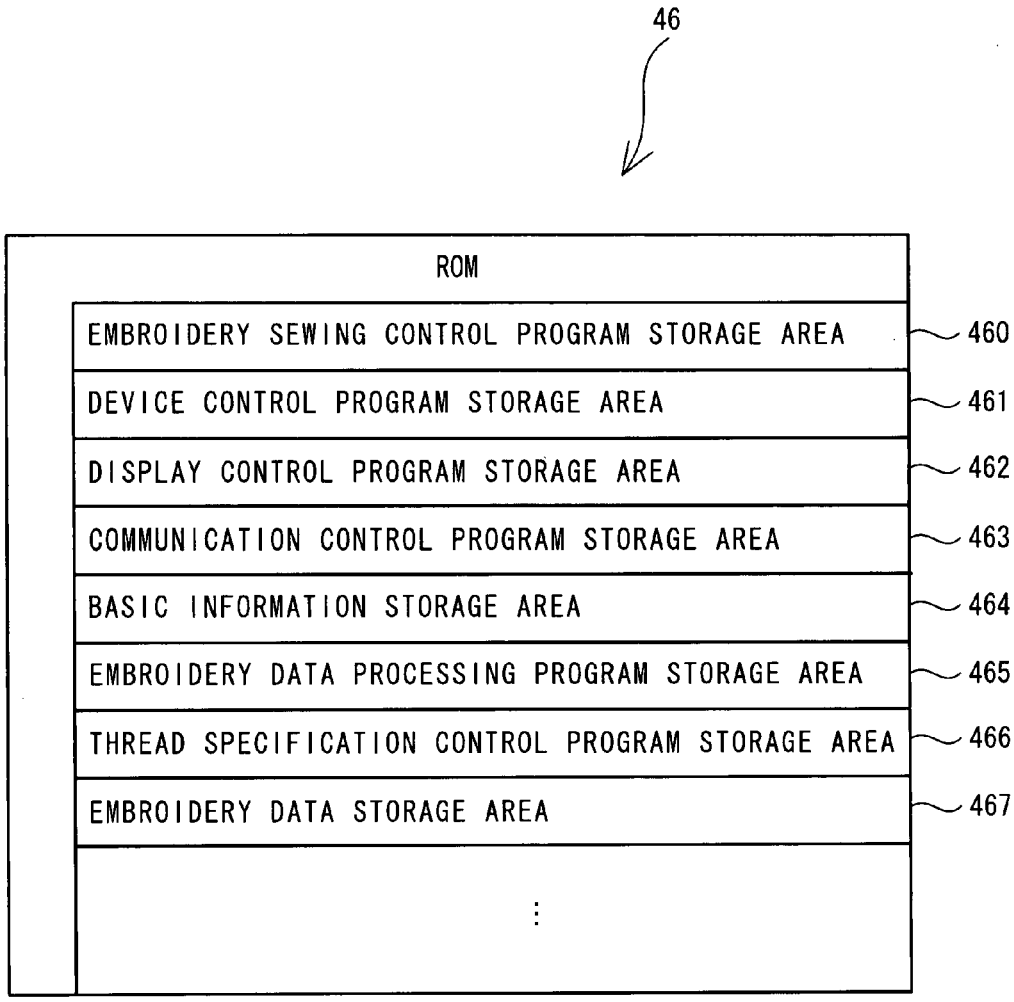
FIG. 5 is a conceptual view showing storage areas of a ROM.
Figure 6:
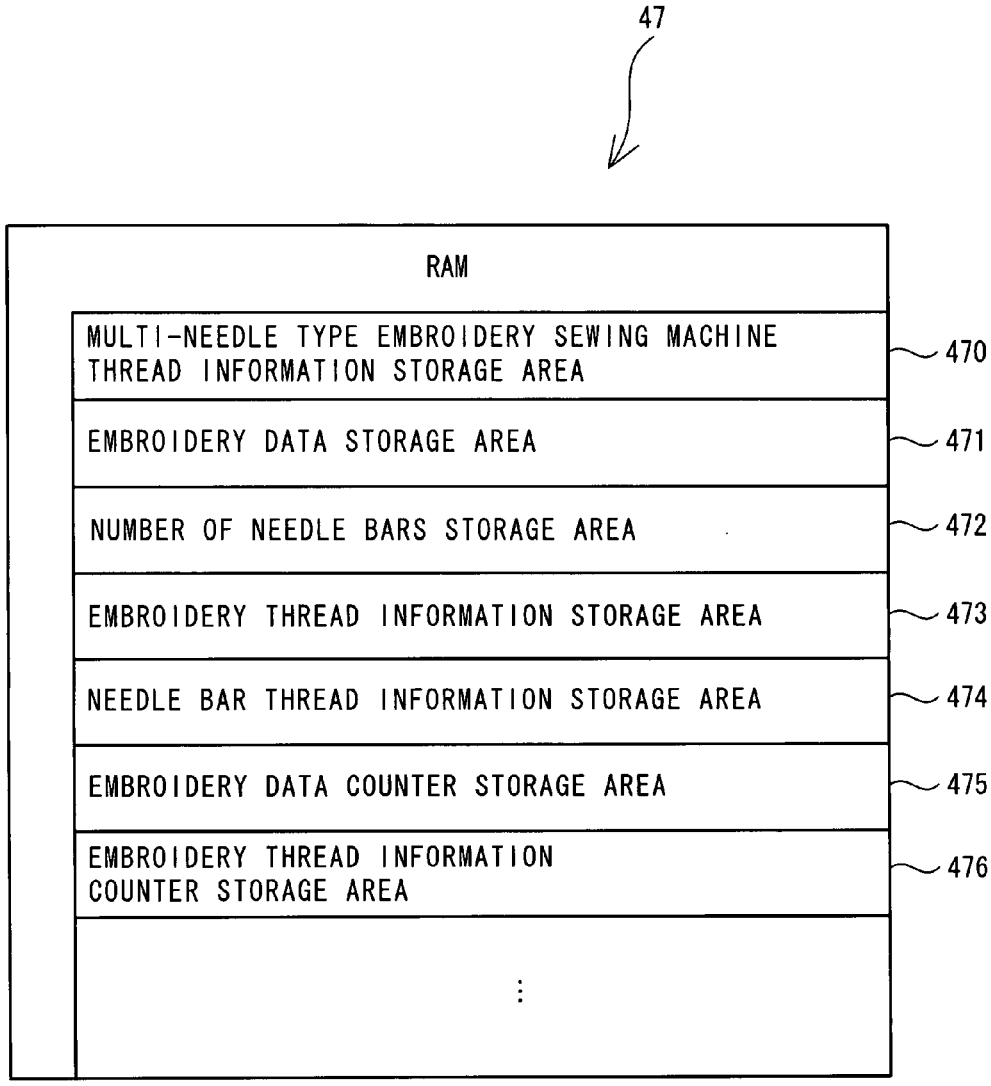
FIG. 6 is a conceptual view showing storage areas of a RAM.

Referring to FIGS. 4 to 6, a description will be given with respect to an electrical configuration responsible for control of a multi-needle type embroidery sewing machine 11. As shown in FIG. 4, the sewing machine 11 includes constituent elements such as a sewing needle drive portion 57, an embroidery target drive portion 65, and a control unit 41.

The sewing needle drive portion 57 is provided with a sewing machine motor 54 that reciprocally moves the needle bar 27 in a vertical direction, and a drive shaft driver circuit 51 that drives the sewing machine motor 54 in accordance with a control signal from the control unit 41. In addition, the sewing needle drive portion 57 is provided with a switching mechanism 55 that switches the needle bar 27, and a switching mechanism driver circuit 52 that drives the switching mechanism 55 in accordance with a control signal from the control unit 41. Further, the sewing needle drive portion 57 is provided with a cutting mechanism 56 that cuts a thread set for a sewing needle 19 (refer to FIG. 1 and FIG. 2), and a cutting mechanism driver circuit 53 that drives the cutting mechanism 56 in accordance with a control signal from the control unit 41.

The embroidery target drive portion 65 is provided with an X-axis motor 63 that moves the embroidery frame (not shown) in a transverse direction relative to the front to rear direction of the sewing machine 11, and an X-axis driver circuit 61 that drives the X-axis motor 63 in accordance with a control signal from the control unit 41. In addition, the embroidery target drive portion 65 is provided with an Y-axis motor 64 that moves an embroidery frame (not shown) in a longitudinal direction (i.e., substantially parallel to the front to rear direction of the sewing machine 11) and a Y-axis driver circuit 62 that drives the Y-axis motor 64 in accordance with a control signal from the control unit 41.

The control unit 41 is composed of a CPU 45, a ROM 46, a RAM 47, an EEPROM 48, and an input/output interface (I/O) 50 and the like, each interconnected by means of a bus 49. In addition to the sewing needle drive portion 57 and the embroidery target drive portion 65, an FDD 31, a touch panel 32 and an LCD driver circuit 66 that controls a liquid crystal display 30 are connected to the input/output interface 50, respectively.

The CPU 45 is responsible for main control of the multi-needle embroidery sewing machine 11, and executes a variety of computations and processes relevant to embroidery sewing in accordance with a control program stored in the ROM 46 (read-only memory). In addition, the CPU 45 executes a variety of computations and processes in accordance with an embroidery data processing program stored in the ROM 46. The embroidery data processing program may be stored in an external storage device such as a floppy disk. In this embodiment, the program is read into the RAM 47, and then executed.

The ROM 46 includes storage areas that store programs for operating the sewing machine 11 based on embroidery data. A detailed description of the ROM 46 will be given with reference to FIG. 5. As shown in FIG. 5, the ROM 46 is provided with storage areas such as an embroidery sewing control program storage area 460, a device control program storage area 461, a display control program storage area 462, a communication control program storage area 463, a basic information storage area 464, an embroidery data processing program storage area 465, a thread specification control program storage area 466, and an embroidery data storage area 467. The embroidery sewing control program storage area 460 stores a program that controls driving of devices necessary for embroidery sewing. The device control program storage area 461 stores a program that controls devices targeted for control of operations other than embroidery sewing. The display control program storage area 462 stores a program that controls the liquid crystal display 30. The communication control program storage area 463 stores a program that exchanges commands or data between the sewing machine 11 and an external device. The basic information storage area 464 stores device type information, embroidery area size information, the number of needle bars 27 and the like. The embroidery data processing program storage area 465 stores a program according to this disclosure. The thread specification control program storage area 466 stores an all-thread information table containing a list of all thread information relevant to a plurality of thread types used for embroidery sewing, a thread specification control program for a user to associate a needle bar 27 with thread information on an upper thread supplied from a thread spool 22, and the like. The all-thread information table can include thread information relevant to more than several thousand types of threads. Thread information on each thread can be composed of a thread information number, a manufacturer's name, a thread color, name, thickness, a material, and the like. The thread information number denotes a specific number assigned for each thread information. This thread information number can uniquely specify thread information. The embroidery data storage area 467 stores embroidery data that serves as data for sewing an embroidery pattern.

The RAM 47 is a storage device which is randomly readable and writable, and a variety of storage areas are provided for storing a computation result obtained through a computational process of the CPU 45 as required. A detailed description of the RAM 47 will be given with reference to FIG. 6. As shown in FIG. 6, the storage areas of the RAM 47 include a multi-needle type embroidery sewing machine thread information storage area 470, an embroidery data storage area 471, a number of needle bars storage area 472, an embroidery thread information storage area 473, a needle bar thread information storage area 474, an embroidery data counter storage area 475, and an embroidery thread information counter storage area 476. The multi-needle type embroidery sewing machine thread information storage area 470 stores thread information relating to threads set for the sewing machine 11. The embroidery data storage area 471 stores data on a plurality of embroidery patterns. The number of needle bars storage area 472 stores a number of needle bars N. The embroidery thread information storage area 473 stores embroidery thread information included in the embroidery data. The needle bar thread information storage area 474 stores needle bar thread information. The embroidery data counter storage area 475 stores a counter for sequentially reading out embroidery data. The embroidery thread information counter storage area 476 stores a counter for reading out embroidery thread information in accordance with a sewing sequential order.

The multi-needle type embroidery sewing machine 11 described above can function as an embroidery data processing apparatus according to this embodiment, and can automatically extract an embroidery pattern that satisfies an embroidery sewing condition from among a plurality of embroidery patterns stored in the sewing machine 11. The embroidery sewing condition used here denotes a condition defined by the embroidery data and the settings of the sewing machine 11 such as a number of needle bars and needle bar thread information at the time of sewing an embroidery pattern. Thread information, a thread replacement count, a number of needle drop points (stitch points), an embroidery sewing time, an embroidery sewing size, and the like are examples of embroidery sewing conditions.

Figure 9:
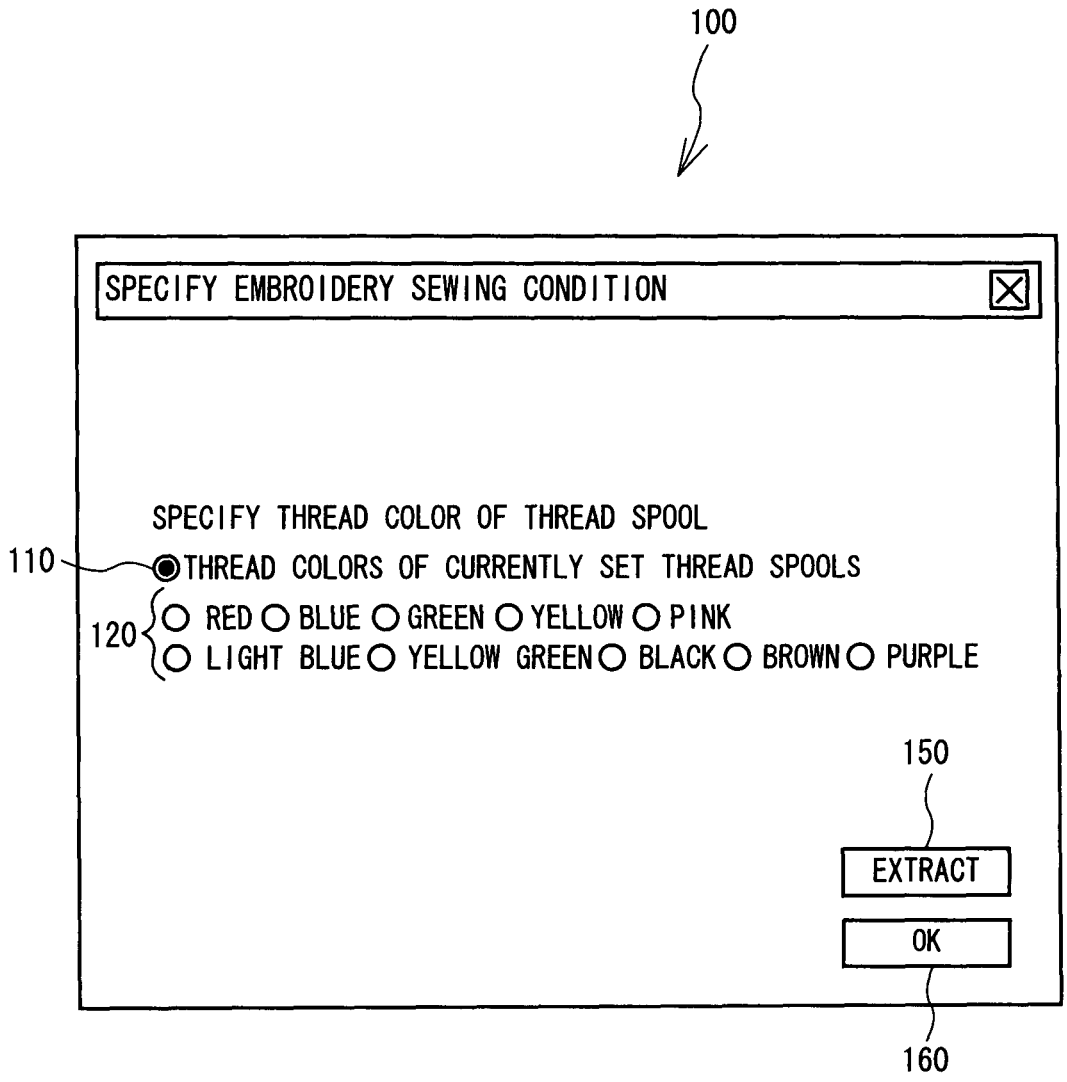
FIG. 9 illustrates a display screen for specifying an embroidery sewing condition.
Figure 10:
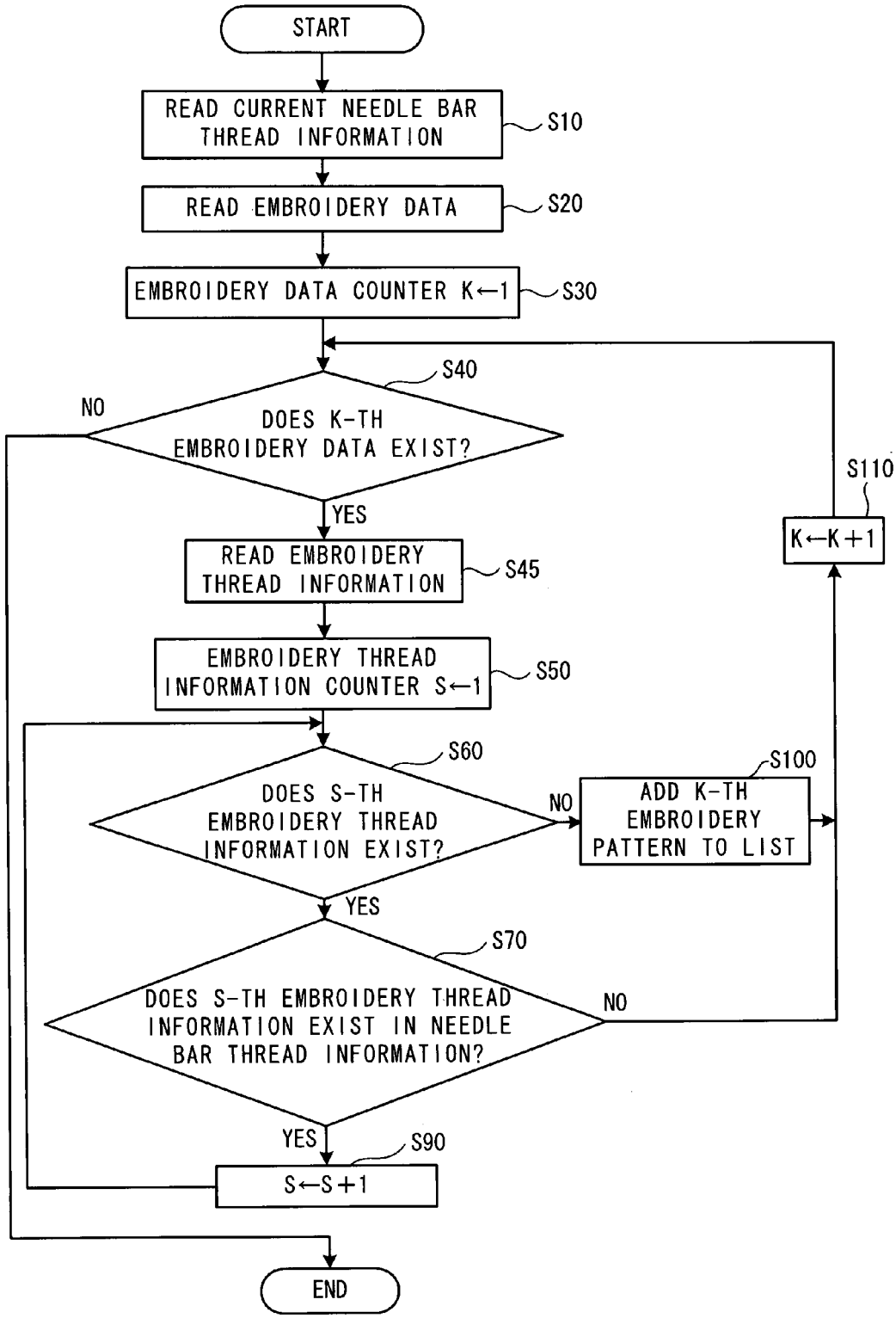
FIG. 10 is a flowchart showing an embroidery pattern extraction process.

Referring now to FIGS. 7 to 11, a description will be given with respect to Example 1 of extracting an embroidery pattern that can be sewn with the threads set for the needle bars 27 from among five embroidery patterns shown in FIG. 7 by using the sewing machine 11 described above. A program for executing an embroidery pattern extraction process shown in FIG. 10 is stored in the embroidery data processing program storage area 465 of the ROM 46 (refer to FIG. 5), and is executed by the CPU 45 shown in FIG. 4.

First, a description will be given with respect to a configuration of embroidery data stored in the embroidery data storage area 467 of the ROM 46. The embroidery data includes needle drop point data indicating a position of a needle drop point, and embroidery thread information including thread color of a thread spool 22 provided for embroidery sewing. The embroidery data is read into the RAM 47 and used when embroidery sewing or editing process of an embroidery pattern is carried out by the use of the sewing machine 11. For embroidery data, embroidery thread information and needle drop point data are set together in a sequential order of embroidery sewing (hereinafter, referred to as "embroidery sewing sequential order") for each embroidery sewing area, in which one or more stitches are to be formed with the use of threads of identical thread information. Therefore, an embroidery pattern of a desired embroidery sewing condition can be extracted by referring to the embroidery data. The embroidery data may be stored in an external storage medium such as, for example, a floppy disk, a USB memory or a ROM cartridge, and read into the RAM 47 without storing the data in the ROM 46.

Referring now to FIG. 7, a description will be given with respect to embroidery thread information included in the embroidery data of Example 1 that is stored in the ROM 46 of the sewing machine 11. In Example 1, it is assumed that thread information is composed of only information relevant to a thread color, and it also is assumed that five embroidery patterns are stored in the ROM 46, as shown in FIG. 7. As shown in FIG. 7, embroidery pattern 1 has five items of embroidery thread information, and may be sewn with threads of light blue, yellow green, purple, green, and light blue in this particular embroidery sewing sequential order. An embroidery pattern 2 has six items of embroidery thread information, and may be sewn with threads of yellow green, red, purple, deep (dark) green, sky blue and gold in this particular sequential order. An embroidery pattern 3 has six items of embroidery thread information, and may be sewn with threads of green, light blue, purple, gold, light blue, and pink in this particular sequential order. An embroidery pattern 4 has six items of embroidery thread information, and may be sewn with threads of red, light blue, green, purple, yellow green and green in this particular sequential order. An embroidery pattern 5 has six items of embroidery thread information, and may be sewn with threads of sky blue, black, light blue, pink, blue, and brown in this particular sequential order.

Referring now to FIG. 8, a description will be given with respect to needle bar thread information on threads set at t sewing machine 11. As shown in FIG. 8, threads of yellow green, purple, light blue, red, gold, and green are set for a respective one of six needle bars 27 (refer to FIG. 3) of needle bar numbers 1 to 6. These items of needle bar thread information are associated with needle bar numbers, and are stored in the multi-needle type embroidery sewing machine thread information storage area 470 of the RAM 47. These items of needle bar thread information may be input by a user to be stored in the multi-needle type embroidery sewing machine thread information storage area 470. Alternatively, a thread information sensor that detects needle thread information may be installed on each spool pin 26 (refer to FIGS. 1 and 2) of the sewing machine 11, whereby information detected by the thread information sensor may be stored in the multi-needle type embroidery sewing machine thread information storage area 470.

Referring now to FIG. 9, a description will be given with respect to a screen 100 for specifying an embroidery sewing condition. As shown in the screen 100, in the first embodiment, option buttons 110 or 120 each associated with a condition may be turned ON or OFF, whereby a thread color(s) of thread spools 22 to be used for sewing an embroidery pattern can be specified as an embroidery sewing condition. Condition 1, selected by means of the option button 110 displayed on the screen 100, is a condition under which there may be extracted an embroidery pattern that can be sewn with currently set thread spools. In other words, under this condition, an embroidery pattern, having data in which each item of the embroidery thread information is coincident with any item of needle bar thread information on the threads set at the needle bars 27, may be extracted. By specifying condition 1 as an embroidery sewing condition, an embroidery pattern that can be sewn without replacing any currently set thread may be extracted. On the other hand, when any of the option buttons 120 corresponding to the thread colors shown on the screen 100 is turned ON, condition 2 is selected. Condition 2 is a condition under which there may be extracted an embroidery pattern that can be sewn with a thread spool of a thread color selected from the colors displayed on the screen 100 (that is, the user can select one or more of the colors listed by selecting the option button 120 adjacent to that color). In other words, under this condition, an embroidery pattern, having embroidery data in which each item of the embroidery thread information is coincident with any item of specified thread information on a thread color selected by means of the option buttons 120, may be extracted. By specifying condition 2 as an embroidery sewing condition, an embroidery pattern can be extracted that can be sewn by means of a thread of a desired color corresponding to option buttons 120. When a user turns ON any one of the option buttons 110 and 120 of embroidery sewing conditions displayed on the screen 100 and selects the extraction button 150, an embroidery sewing condition is specified. On the other hand, when an OK button 160 is selected, the process of specifying an embroidery sewing condition is interrupted, and the screen 100 is closed. In addition, option buttons 110 and 120 can be selected at the same time.

Referring now to a flowchart shown in FIG. 10, a description will be given with respect to processing procedures for extracting an embroidery pattern that satisfies condition 1 as an embroidery sewing condition from among embroidery patterns 1 to 5. First, an option button 110 of condition 1, shown in the screen 100 of FIG. 9, is turned ON, and an extraction button 150 is selected. Then, the multi-needle type embroidery sewing machine thread information storage area 470 is referenced. Needle bar thread information "yellow green, purple, light blue, red, gold, and green" currently set for the sewing machine 11 is read, and the read out information is stored in the needle bar thread information storage area 474 (S10). Embroidery data on the embroidery patterns stored in the embroidery data storage area 467 of the ROM 46 is then read, and the read out data is stored in the embroidery data storage area 471 (S20).

Subsequently, embroidery data counter K for sequentially reading out embroidery data read in S20 is set to 1, and the value is stored in an embroidery data counter storage area 475 (S30). Then, the embroidery data storage area 471 is referenced, and it is determined whether the first embroidery data (K=1) is stored there (S40). This process serves for sequentially reading out embroidery data in the order of numbers 1 to 5 assigned to each embroidery pattern. In Example 1, as the first embroidery data, it is determined that embroidery data on the embroidery pattern 1 is stored in the embroidery data storage area 471 (S40: Yes). Therefore, embroidery thread information included in this first embroidery data and the associated embroidery sewing sequential order are acquired, and the acquired information and embroidery sewing sequential order are stored in the embroidery thread information storage area 473 (S45). Then, an embroidery thread information counter S for reading out the embroidery thread information in accordance with the embroidery sewing sequential order is set to 1, and the value is stored in the embroidery thread information counter storage area 476 (S50).

Next, the embroidery thread information storage area 473 and the embroidery thread information counter storage area 476 are referenced, and it is determined, for example, that there exists first embroidery thread information "light blue" of which embroidery sewing sequential order is 1 (S=1) (S60: Yes). The process of S60 serves for reading out the embroidery thread information in accordance with the embroidery sewing sequential order until it is determined that the embroidery thread information of which embroidery sewing sequential order is S is not stored (S60: No). Following S60, the embroidery thread information storage area 473, the embroidery thread information counter storage area 476, and the needle bar thread information storage area 474 are referenced, and it is determined whether any item of the needle bar thread information coincident with the first embroidery thread information "light blue" is stored in the needle bar thread information storage area 474 (S70). This process serves for determining whether the embroidery data including S-th embroidery thread information can be sewn without replacing a thread of the threads of current needle bar thread information (threads set at the multi-needle sewing machine 11). In S70, in the case where there is no item in the needle bar thread information that is coincident with the S-th embroidery thread information (S70: No), thread replacement is required for carrying out embroidery sewing with the thread of the S-th embroidery thread information. Therefore, condition 1 serving as an embroidery sewing condition is not satisfied, and a process for reading the next embroidery data is carried out (S110). In Example 1, "yellow green, purple, light blue, red, gold, and green" is stored as the needle bar thread information, and the item "light blue" coincident with the embroidery thread information "light blue" is stored in the needle bar thread information (S70: Yes). Therefore, the embroidery thread information counter storage area 476 is then referenced in order to read out the embroidery thread information on the next embroidery sewing sequential order; the embroidery thread information counter 1 is incremented by 1, and the incremented value is stored in the embroidery thread information counter storage area 476 (S90). Then, the current process returns to step S60 and above-described processing is repeated.

Figure 11:
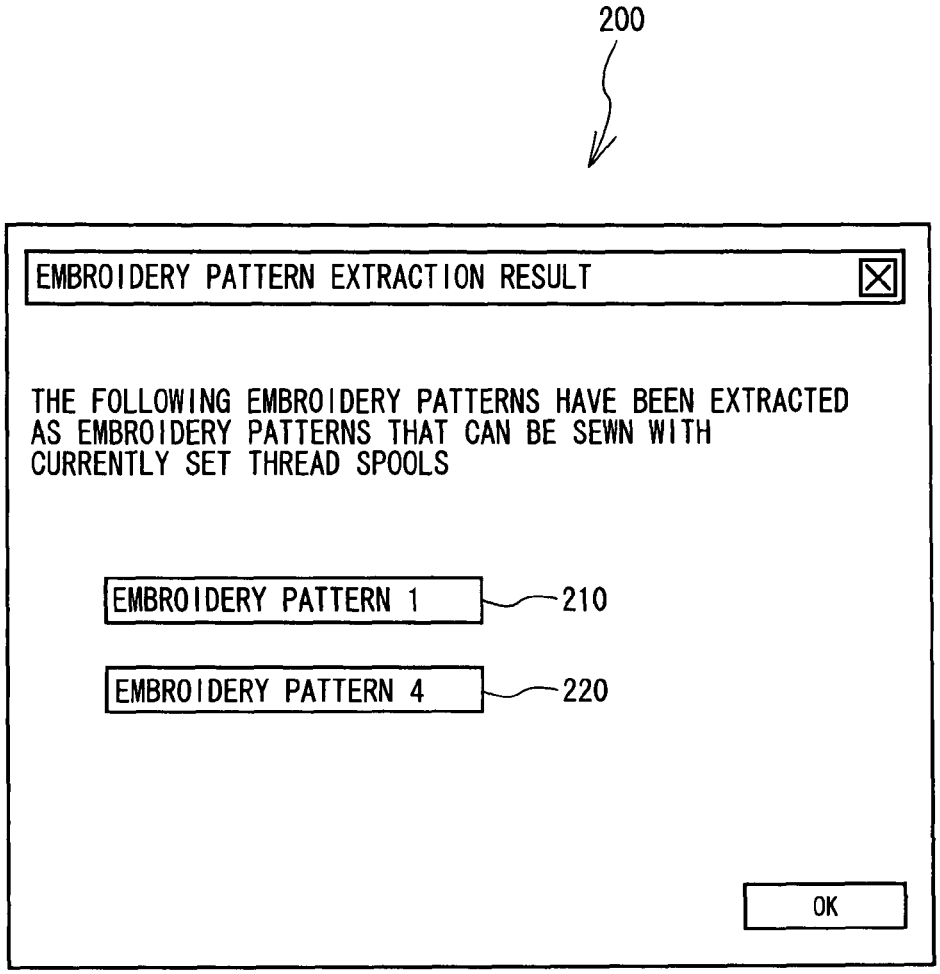
FIG. 11 illustrates a display screen for displaying an embroidery pattern extracted through an extraction process.

In the repeated processing, as in the case where the embroidery sewing sequential order is 1, it is determined whether each item of the embroidery thread information on the embroidery pattern 1 is coincident with the needle bar thread information (S70). Specifically, it is determined that items of the embroidery thread information "yellow green, purple, green, and light blue" of the embroidery sewing sequential orders 2 to 5 of the embroidery pattern 1 each coincides with any item of the needle bar thread information "yellow green, purple, light blue, red, gold, and green" (S70: Yes). After it has been determined that the fifth embroidery thread information coincides with the needle bar thread information (S70: Yes), the embroidery thread information counter storage area 476 is referenced, and counter value 6, obtained by incrementing the embroidery thread information counter value 5 by 1, is stored in the embroidery thread information counter storage area 476 (S90). Then, the embroidery thread information storage area 473 is referenced, and it is determined that the sixth embroidery thread information is not stored (S60: No). As a result, as shown in FIG. 11, the embroidery pattern 1 (210) is added to a list of a screen 200 that displays an embroidery pattern extraction result (S100). In this way, an embroidery pattern satisfying an embroidery sewing condition is added to the list on the screen 200 every time the pattern is extracted, and a user can thus check the extracted embroidery pattern at any time. Next, the embroidery data counter 1 (K=1) is incremented by 1 in order to read out the next embroidery data, and the incremented value is stored in the embroidery data counter storage area 475 (S110).

Thereafter, the processes of step S40 to step S110 are repeated in the same manner as is the case of the first embroidery data of the embroidery pattern 1. Specifically, it is determined whether there is stored needle bar thread information that is coincident with the embroidery thread information included in the embroidery data on embroidery patterns 2 to 5 (S70). Finally, from among the embroidery data on embroidery patterns 2 to 5, embroidery pattern 4 (220) is extracted as an embroidery pattern that satisfies the embroidery sewing condition, and the extracted pattern (220) is added to the list on the screen 200 of FIG. 11 (S100). After it has been determined that the item "sky blue" in the embroidery thread information, of which the sequence in the embroidery pattern 5 is 1, is not coincident with any item in the needle bar thread information (S70: No), the embroidery data counter storage area 475 is referenced, and counter value 6 obtained by incrementing the embroidery data counter 5 by 1 is stored in the embroidery data counter storage area 475 (S110). Then, the embroidery data storage area 471 is referenced, it is determined that sixth embroidery data is not stored (S40: No), and processing is terminated.

In accordance with the processes described above, embroidery patterns 1 (210) and 4 (220) are extracted as embroidery patterns that satisfy condition 1, and embroidery patterns 1 and 4 are displayed on the screen 200 as shown in FIG. 11. In the case where condition 2 has been employed as an embroidery sewing condition, in step S10 shown in FIG. 10, specified thread information on thread color selected by the option buttons 120 may be read instead of the needle bar thread information, and the specified thread information may be stored in a predetermined storage area of the RAM 47. In step S70, it may be determined whether the specified thread information coincident with the S-th embroidery thread information is stored in the RAM 47. Similarly, in the case where both of conditions 1 and 2 have been employed as embroidery sewing conditions, in step S10 shown in FIG. 10, the needle bar thread information and the specified thread information on the thread color selected as condition 2 may be read so as to be stored in a predetermined storage area of the RAM 47. In step S70, it may be determined whether needle bar thread information or the specified thread information coincident with the S-th embroidery thread information is stored in the RAM 47.

According to the multi-needle type embroidery sewing machine 11 of the first embodiment described above, thread information on threads set for the multi-needle type embroidery machine 11 is specified by the touch panel 32 as information serving as a sewing condition, whereby an embroidery pattern satisfying this sewing condition can be automatically extracted. Therefore, when an embroidery pattern that can be sewn with threads of desired thread information is selected from among a plurality of embroidery patterns, the trouble of checking each item of embroidery data on each embroidery pattern can be eliminated. In addition, the needle bar thread information serving as thread information on threads set at the sewing machine 11 can be specified as the specified thread information. Therefore, as in the case of Example 1, by extracting an embroidery pattern having embroidery data in which all items of the embroidery thread information are each coincident with the needle bar thread information, there can be extracted an embroidery pattern that can be sewn with the threads set at the sewing machine 11 without replacing a thread. In addition, in the case where a user attempts to extract an embroidery pattern that can be sewn with threads currently possessed by the user, thread information on the threads is specified as the specified thread information (e.g., condition 2), whereby an embroidery pattern that can be sewn with the threads of the thread information specified by the user can be automatically extracted. Further, the information includes thread color information. Thus, the embroidery pattern that can be sewn with a thread of a desired color can be automatically extracted by specifying the thread information that is visually recognized. Furthermore, the extracted embroidery pattern can be displayed and viewed on the liquid crystal display 16.

As in the case of the first embodiment where thread information is employed as an embroidery sewing condition, there can be extracted an embroidery pattern having thread information that coincides with the thread information included in the embroidery data. For example, the thread color included in the thread information may be expressed by the RGB values. In such a case, the above-described process for extracting an embroidery pattern may be carried out, recognizing thread colors of slightly different RGB values as different thread colors. Thus, even in the case where a thread color of the embroidery data and that of a thread set for a needle bar can be recognized as substantially identical from the user's point of view, the embroidery data processing apparatus of the first embodiment determines that the colors are different from each other, and that the embroidery sewing condition is not satisfied. Therefore, a modified example of the first embodiment as shown below may be employed.

Referring to a flowchart shown in FIG. 12, a description will be given with respect to a modified example of the first embodiment. In the modified example, an embroidery pattern is extracted as one that satisfies an embroidery sewing condition, if analogous thread information coincides with the embroidery thread information, while no specified thread information coincides with the embroidery thread information. As Example 2, a description will be given with respect to a case of extracting an embroidery pattern that has embroidery data in which all items of the embroidery thread information are each coincident with needle bar thread information or information that is analogous to the needle bar thread information, from embroidery patterns 1 to 5 shown in FIG. 7. A screen for specifying this embroidery sewing condition conforms to the screen shown in FIG. 9. Accordingly, an illustration and a description thereof will be omitted here. In addition, a program for executing an embroidery pattern extraction process according to a modified example of the first embodiment shown in FIG. 12 is stored in an embroidery data processing program storage area 465 of the ROM 46 (refer to FIG. 5), and the program is executed by means of the CPU 45 shown in FIG. 4.

Figure 12:
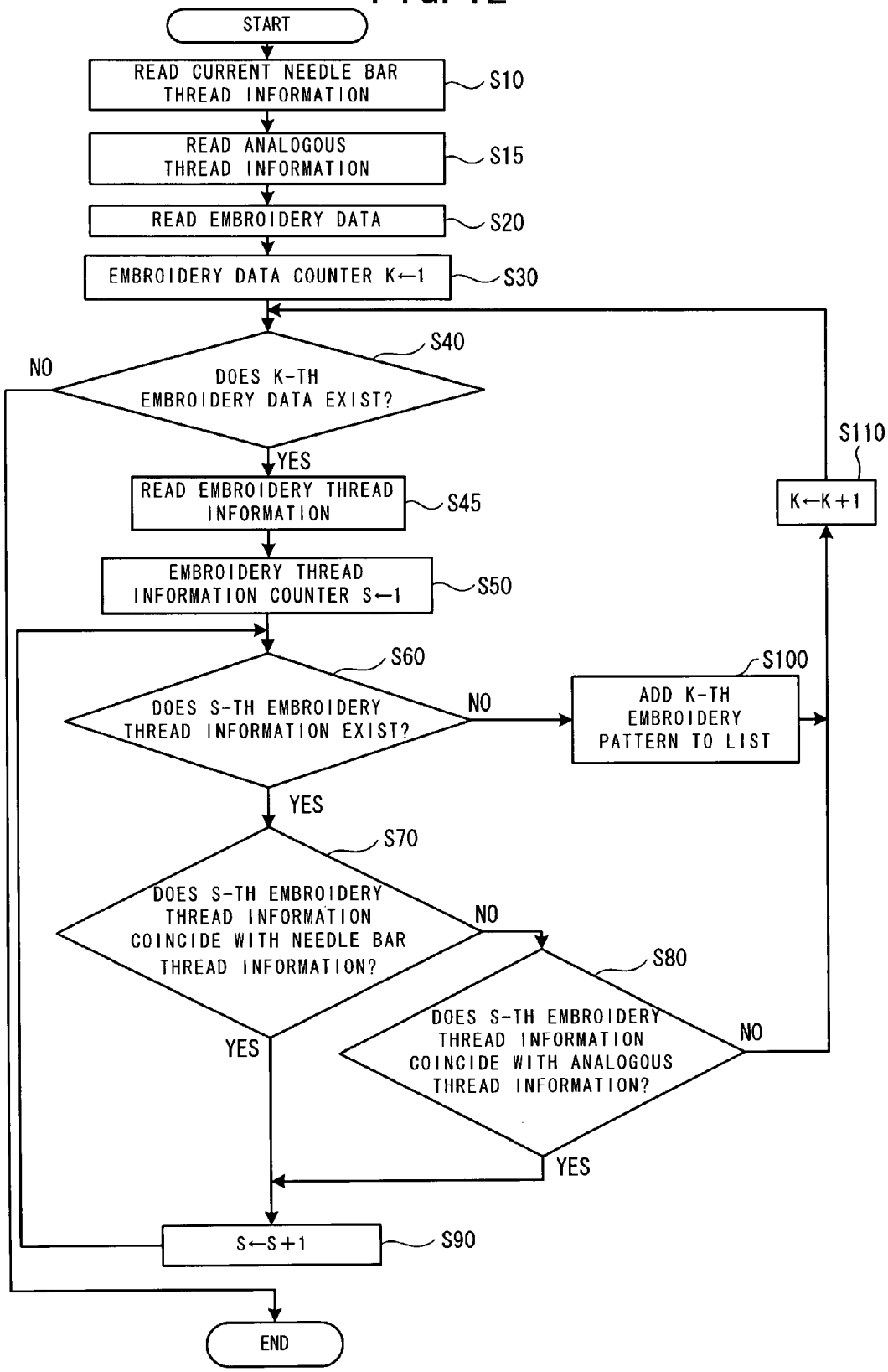
FIG. 12 is a flowchart showing an embroidery pattern extraction process according to a modified example.

As shown in FIG. 12, the flow of an embroidery pattern extraction process according to the modified example of the first embodiment is different from the first embodiment in the processes of S15 and S80. The processes common to those of the first embodiment will not be described here. Referring to FIG. 12, a description will be given with respect to the processes of S15 and S80 that are not included in the first embodiment.

In the embroidery pattern extraction process according to the modified example, the thread information set for the sewing machine 11 determined to be analogous to each thread information stored in the data storage area 467 of the ROM 46 is stored as analogous thread information in an analogous thread information storage area (not shown) of the ROM 46. In addition, in the case where the embroidery thread information does not coincide with the needle bar thread information, it is then determined whether the embroidery thread information coincides with the analogous thread information on the needle bar thread information. Thus, after the process of step S10, the needle bar thread information storage area 474 and the analogous thread information storage area (not shown) of the ROM 46 are referenced in step S15, and the analogous thread information is read. For example, the thread information analogous to the needle bar thread information "yellow green, purple, light blue, red, gold, and green" read in step S10 is read and stored in the analogous thread information storage area (not shown) of the RAM 47. In this process, for example, "olive" is read as the analogous thread information to the needle bar thread information "yellow green", "sky blue" is read as the analogous thread information to the needle bar thread information "light blue", "grass green, deep green" is read as the analogous thread information on the needle bar thread information "green", respectively, from the analogous thread information storage area of the ROM 46. The analogous information is stored in the analogous thread information storage area of the RAM 47 (S15).

In addition, after it has been determined that S-th embroidery thread information does not coincide with the needle bar thread information in step S70 (S70: No), the embroidery thread information storage area 473 and the analogous thread information storage area (not shown) of the RAM 47 are referenced in step S80, and it is determined whether there is analogous thread information coincident with the embroidery thread information (S80). This process serves for extracting an embroidery pattern as one that satisfies an embroidery sewing condition in a case where analogous thread information coincident with the embroidery thread information is stored (S80: Yes) even though the needle bar thread information coincident with the embroidery thread information is not stored (S70: No). For example, in Example 2, among the embroidery thread information items of the embroidery pattern 2 shown in FIG. 7, "deep green" of which the embroidery sewing sequential order is 4 and "sky blue" of which the embroidery sewing sequential order is 5 do not coincide with any item of the needle bar thread information "yellow green, purple, light blue, red, gold, and green". However, each of the embroidery thread information items coincides with one of the analogous thread information "olive, sky blue, grass green, and deep green" on the needle bar thread information read in step S15 (S80: Yes). In other words, each item of the embroidery thread information "yellow green, red, purple, deep green, sky blue, and gold" on embroidery pattern 2 coincides with the thread information on either the needle bar thread information "yellow green, purple, light blue, red, gold, and green" or the analogous thread information "olive, sky blue, grass green, and deep green", and thus is extracted as an embroidery pattern that satisfies the embroidery sewing condition (S100).

In accordance with a modified example of the first embodiment, as an embroidery pattern that satisfies an embroidery sewing condition of Example 2, embroidery pattern 2 is extracted from among embroidery patterns 1 to 5 shown in FIG. 7 in addition to embroidery patterns 1 and 4 extracted in the first embodiment.

According to this modified example, by specifying analogous thread information, an embroidery pattern with a thread color of which the RGB value is slightly different from the specified thread information can be extracted as an embroidery pattern that satisfies an embroidery sewing condition. Thus, a variety of embroidery patterns suitable for the user's preference or convenience can be sewn. In addition to a case of storing the analogous thread information in advance in a storage device such as the ROM 46, the analogous thread information may be stored after the user specifies an analogous relationship of thread information. Alternatively, a degree of analogousness D with the thread information stored in the ROM 46 is obtained from the RGB value of the specified thread information so that thread information of the degree of analogousness D satisfying a predetermined condition may be read out as the analogous thread information. As a method for calculating the degree of analogousness D, by using the RGB value included in the thread information, for example, when the RGB value of the specified thread information is (R1, G1, B1) and that of the thread information stored in the ROM 46 is (R2, G2, B2), $D=(R1-R2)^2+(G1-G2)^2+(B1-B2)^2$ can be employed. If the analogous thread information is defined by the calculated degree of analogousness D, the trouble of defining the analogous thread information in advance can be eliminated. In addition, the analogous thread information can be defined by a unified objective standard with respect to all thread information.

Figure 13:
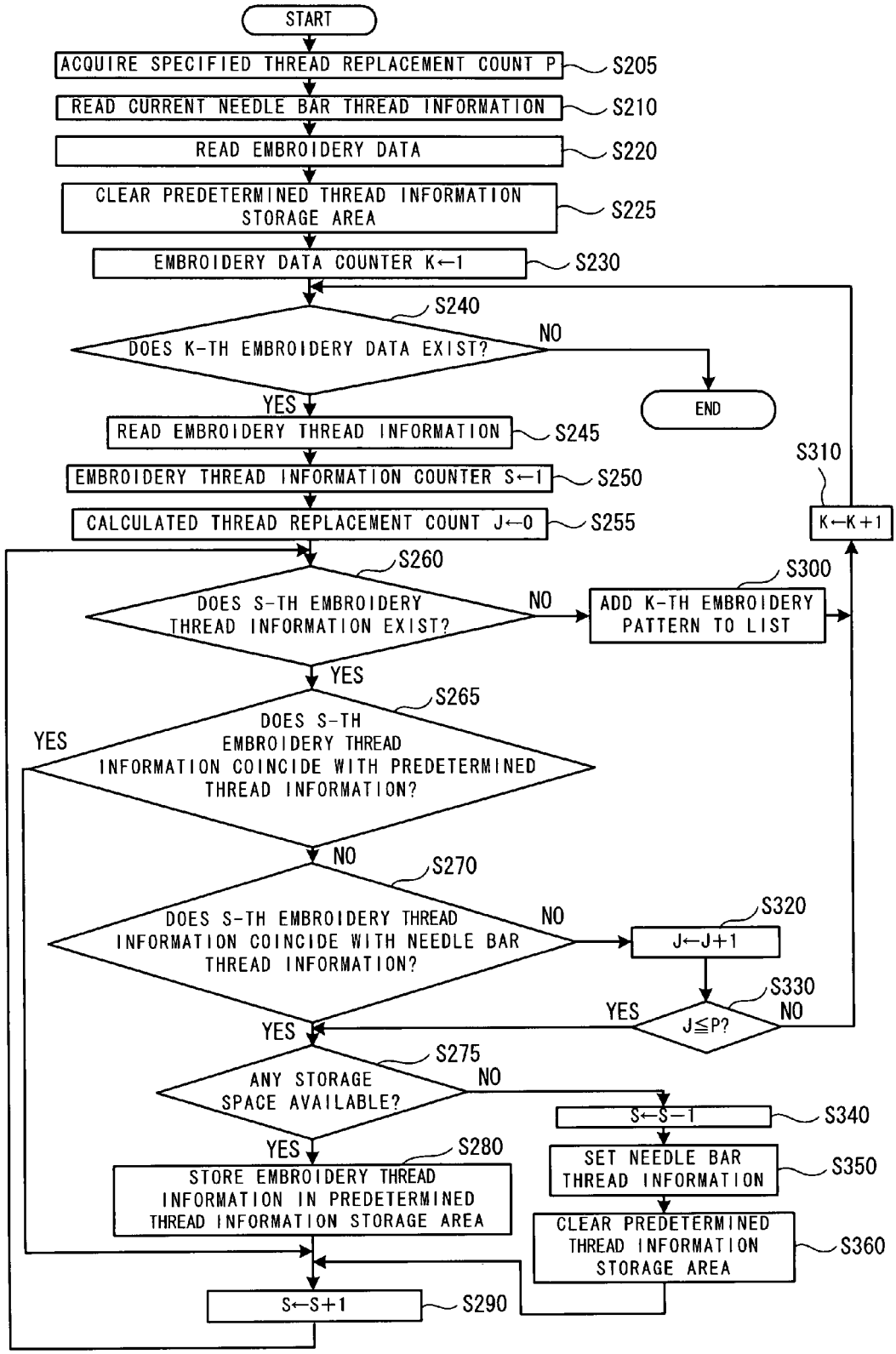
FIG. 13 is a flowchart showing an embroidery pattern extraction process according to another embodiment.

Referring now to the flowchart shown in FIG. 13, a description will be given with respect to a second embodiment. In the second embodiment, as an embroidery sewing condition, a thread replacement count (number of times a thread replacement is required) during sewing an embroidery pattern by the multi-needle type embroidery sewing machine 11 described above is specified. The embroidery pattern of which the thread replacement count is 0 is an embroidery pattern that can be sewn by means of thread spools set at the sewing machine 11 without making any thread replacement, as was extracted under the above-described condition 1 of Example 1 in the first embodiment. In addition, an embroidery pattern of which thread replacement count is 1 is an embroidery pattern that can be sewn by replacing any of the currently set thread spools one time. Further, a physical configuration and an electrical configuration of the sewing machine 11 according to the present embodiment are different from those of the first embodiment only with respect to the storage areas of the RAM 47. Other components are identical. The storage areas of the RAM 47 that are different from those of the first embodiment will be described below, and a description of other aspects similar to the first embodiment will be omitted here. In addition, a screen for specifying an embroidery sewing condition conforms to the screen shown in FIG. 9, and thus an illustration and description also will be omitted here. In the present embodiment, as Example 3, a description will be given with respect to a case of extracting an embroidery pattern of which the thread replacement count is equal to or smaller than 1 from among the embroidery patterns 1 to 5 shown in FIG. 7. For simplicity, as in Example 1, Example 3 assumes that thread information is composed of only information relevant to thread colors. In the sewing machine 11 as shown in FIG. 8, it is assumed that each thread spool corresponding to the needle bar thread information "yellow green, purple, light blue, red, gold, and green" is set at the respective needle bars 27 of needle bar numbers 1 to 6.

First, a RAM 47 according to a second embodiment will be described here. In the RAM 47, in addition to the storage areas of the RAM 47 according to the first embodiment shown in FIG. 6, there are provided a specified thread replacement count storage area, a thread replacement count storage area, and a predetermined thread information storage area (not shown). The specified thread replacement count storage area stores a thread replacement count P specified by a user. The thread replacement count storage area stores a thread replacement count J calculated by comparing the needle bar thread information and the embroidery thread information included in the embroidery data. The predetermined thread information storage area preliminarily stores predetermined thread information relating to the six items of thread information expected to be set as needle bar thread information, the number of the items being equal to the number of needle bars 27.

In the second embodiment, the thread replacement count is calculated assuming (a) that embroidery sewing is carried out with the embroidery data in accordance with the embroidery sewing sequential orders as long as it can be continued without a thread replacement, and (b) that the thread replacement should be made in a batch immediately before carrying out embroidery sewing based on the embroidery data requiring a thread replacement. Therefore, in a screen similar to that of FIG. 9, if a user specifies the thread replacement count as 1, the specified thread replacement count P is acquired and stored in the specified thread replacement count storage area (not shown) of the RAM 47 (S205 in FIG. 13). As shown in FIG. 13, as in the first embodiment, the needle bar thread information is then read and stored in the needle bar thread information storage area 474 (S210). Subsequently, embroidery data is read out from the ROM 46 and stored in the embroidery data storage area 471 (S220).

Next, the predetermined thread information stored in the predetermined thread information storage area (not shown) of the RAM 47 is cleared (S225). A purpose of this process is to clear the predetermined thread information that has been used previously for comparing the thread replacement counts and stored in the predetermined thread information storage area (not shown).

Subsequently, an embroidery data counter K for sequentially reading out the embroidery data is set to 1, and the value is stored in the embroidery data counter storage area 475 (S230). Then, it is determined, for example, that there exists embroidery data on the embroidery pattern 1 serving as a first embroidery data (K=1) (S240: Yes). This step serves for continuing the process until all of the embroidery data has been sequentially read out. The embroidery data storage area 471 is then referenced, and among the embroidery data on the embroidery pattern 1, the embroidery thread information and the associated embroidery sequential orders are stored in the embroidery thread information storage area 473 (S245). An embroidery thread information counter S for reading out the embroidery thread information in accordance with the embroidery sewing sequential order is set to 1, and the value is stored in the embroidery thread information counter storage area 476 (S250). Subsequently, a calculated thread replacement count J for calculating the thread replacement count during sewing of a K-th embroidery pattern is set to 0, and the value is stored in the thread replacement count storage area (not shown) of the RAM 47 (S255).

Next, the embroidery thread information storage area 473 is referenced, and it is determined, for example, that the first embroidery thread information "light blue" is stored (S260: Yes). This step serves for reading out all items of the embroidery thread information in accordance with the embroidery sequential order. It is then determined whether predetermined thread information coincident with this first embroidery thread information "light blue" is stored in the predetermined thread information storage area (not shown) of the RAM 47 (S265). This step serves for storing the embroidery thread information items in the predetermined thread information storage area (not shown) by the number of needle bars 27 (refer to FIG. 3 and FIG. 4), and then setting the needle bar thread information after a thread replacement based on the stored predetermined thread information (S350). In accordance with such a process, a thread replacement count J can be calculated assuming that embroidery sewing is continued with the embroidery data of the embroidery sewing sequential orders as long as a thread replacement is not required, and that a thread replacement should be made in a batch immediately before carrying out embroidery sewing based on the embroidery data requiring a thread replacement.

In step S225, the predetermined thread information storage area (not shown) of the RAM 47 has been cleared (S265: No). Thus, the embroidery thread information storage area 473 and the needle bar thread information storage area 474 are referenced, and it is determined whether the needle bar thread information that is coincident with the first embroidery thread information item "light blue" is stored (S270). This step serves for determining whether a thread replacement is required in order to carry out embroidery sewing with a thread of S-th embroidery thread information. Therefore, in the case where it is determined that the S-th embroidery thread information item is not coincident with any item of the needle bar thread information (S270: No), it is determined that a thread replacement is required, the calculated thread replacement count J is incremented by 1, and the incremented value is stored in the thread replacement count storage area (not shown) of the RAM 47 (S320). Then, the thread replacement count storage area and the specified thread replacement count storage area (not shown) of the RAM 47 are referenced, and it is determined whether the calculated thread replacement count J is equal to or smaller than the specified thread replacement count P acquired in step S205 (S330). If the calculated thread replacement count J is larger than the specified thread replacement count P (S330: NO), it is determined that the K-th embroidery pattern does not satisfy the embroidery sewing condition. The process for reading out all of the embroidery thread information on the K-th embroidery data in accordance with the embroidery sewing sequential orders is then interrupted, and a process for reading out the next embroidery pattern is carried out (S310).

In Example 3, in step S270, it is determined that the first embroidery thread information item "light blue" is stored among the needle bar thread information items "yellow green, purple, light blue, red, gold, and green" (S270: Yes). It is then determined whether available space exists in the predetermined thread information storage area (not shown) of the RAM 47 (S275). As described above, while six items of the predetermined thread information, equal to the number of needle bars 27, can be stored in the predetermined thread information storage area, at this time, no thread information is stored in the predetermined thread information storage area (S275: Yes). Therefore, embroidery thread information item "light blue" is stored in the predetermined thread information storage area (S280). Then, the embroidery thread information counter storage area 476 is referenced, the embroidery thread information counter 1 (S=1) is incremented by 1 in order to read out the embroidery thread information of the next sequential order, and the incremented value is stored in the embroidery thread information counter storage area 476 (S290). Next, the process returns to step S260 and the following process is repeated. In the case where it is determined in step S275 that there is no available space in the predetermined thread information storage area (S275: NO), a process is carried out for setting the needle bar thread information after a thread replacement, assuming that a thread replacement is to be made (S340, S350, S360). In this process, first, the embroidery thread information counter S is decremented by 1, and the decremented value is stored in the embroidery thread information counter storage area 476 (S340). Subsequently, the predetermined thread information storage area and the needle bar thread information storage area 474 are referenced, and the predetermined thread information items stored in the predetermined thread information storage area are stored in the needle bar thread information storage area 474 as the needle bar thread information items on the threads to be set after a thread replacement (S350). Then, the predetermined thread information storage area is referenced, and the predetermined thread information items stored in the predetermined thread information storage area are all cleared (S360).

Following step S290, as is the case with the first embroidery thread information item "light blue", it is determined whether each item of the embroidery thread information of the embroidery sewing sequential orders from 2 to 5 is stored in the predetermined thread information (S265), and whether such each item is stored in the needle bar thread information (S270). As described above, the embroidery thread information on the embroidery pattern 1 has not yet been stored in the predetermined thread information storage area (S265: NO), and each item of the embroidery thread information on the embroidery pattern 1 coincides with any of six items of the needle bar thread information (S270: Yes). Therefore, after the embroidery thread information counter S is incremented by 1 and the obtained counter value 6 is stored (S290), it is determined that the sixth embroidery thread information is not stored (S260: No), and the embroidery pattern 1 is added to a list displayed on the liquid crystal display 30 as an embroidery pattern that satisfies the embroidery sewing condition (S300). Subsequently, the embroidery data counter storage area 475 is referenced in order to read out the next embroidery data, the embroidery data counter 1 (K=1) is incremented by 1, and the incremented value is stored in the embroidery data counter storage area 475 (S310). Next, the process returns to step S240 and the following process is repeated.

When processing is carried out in the same manner as in the case of the embroidery pattern 1, it is determined, for example, that "deep green" of embroidery sewing sequential order 4 and "sky blue" of sequential order 5 of embroidery pattern 2 do not coincide with any item of the needle thread information (S270: No). Thus, the calculated thread replacement count J is obtained as 2 (S320), which is determined to be larger than the specified thread replacement count 1 (S330: No). For the embroidery pattern 3, "pink" of embroidery sewing order 6 does not coincide with any item of the needle bar thread information (S270: No), and thus the calculated thread replacement count J is obtained as 1 (S330: Yes). Therefore, the embroidery pattern 3 is added to a list displayed on the liquid crystal display 30 as an embroidery pattern that satisfies the embroidery sewing condition. That is, the specified thread replacement count is equal to or smaller than 1 (S300). All items of the embroidery thread information on the embroidery pattern 4 each coincide with any of the six items of the needle bar thread information (S270: YES), and the calculated thread replacement count J is obtained as 0. Therefore, the embroidery pattern 4 is added to a list displayed on the liquid crystal display 30 as an embroidery pattern satisfying the embroidery sewing condition (S300). As for the embroidery pattern 5, "sky blue" of embroidery sewing sequential order 1, "black" of embroidery sewing sequential order 2, "pink" of embroidery sewing sequential order 4, "blue" of embroidery sewing sequential order 5, and "brown" of embroidery sewing sequential order 6 each do not coincide with any item of the needle bar thread information (S270: No). As a result, the calculated thread replacement count J is stored as 5 (S320), and it is determined that the stored count is larger than the specified thread replacement count 1 (S330: No).

As described above, with respect to the embroidery patterns 1 to 5, the calculated thread replacement count J and the specified thread replacement count P are compared with each other, and embroidery patterns 1, 3 and 4 are extracted as embroidery patterns of which the calculated thread replacement count is equal to or smaller than 1.

According to the multi-needle type embroidery sewing machine 11 of the second embodiment, the thread replacement count during sewing of an embroidery pattern can be specified as an embroidery sewing condition by means of a touch panel 32, and an embroidery pattern having a desired thread replacement count can be automatically extracted. Therefore, an embroidery pattern can be automatically extracted without considering the trouble or the time of replacing threads.

The present disclosure is not limited to the embodiments described above in detail, and various modifications may be possible. For example, while the above-mentioned embodiments have described a case in which the embroidery data processing apparatus is provided integrally with the multi-needle type embroidery sewing machine 11, this processing apparatus may be provided separately from a sewing machine. In the case where the embroidery data processing apparatus is separately provided, a user may input the needle bar thread information. In addition, the foregoing embodiments have described a case of employing the sewing machine 11 provided with six needle bars, that is capable of carrying out embroidery sewing with six types of threads supplied from thread spools to the sewing needles attached to respective needle bars. However, the present disclosure may be applied to a sewing machine capable of carrying out embroidery sewing by means of at least one needle bar as well as a number of needle bars greater than 6.

In addition, while the foregoing embodiments have described an example of specifying a thread color(s) and a thread replacement count as an embroidery sewing condition, other conditions can be employed that are determined based on the settings of the sewing machine, such as embroidery data including the number of needle bars or needle bar thread information. Other examples include a number of needle drop points (stitch points), an embroidery sewing time and an embroidery sewing size. In the case where the number of needle drop points and the embroidery sewing time are employed as an embroidery sewing condition, an embroidery pattern can be extracted in consideration of a time for sewing an embroidery pattern. Further, in the case where an embroidery size is specified as a embroidery sewing condition, an embroidery pattern suitable for the size of a work cloth can be automatically extracted.

In addition, while the foregoing embodiments have described an example in which thread information is composed of only a thread color (for simplification), other information representing thread attributes such as a thread information number, a manufacturer's name, other name, thickness and a material, for example, can be employed as thread information.

Further, while a liquid crystal display 30 has been used as a display device in the foregoing embodiments, another display device, such as a plasma display for example, may be employed. Further, in the case where there is no need for indicating an embroidery pattern on a display device, including a case of indicating an embroidery pattern extracted by voice from a speaker, a display device may not be provided. Further, while the foregoing embodiments have described a touch panel 32 for specifying an embroidery sewing condition, other devices that make an interface with a user, such as a variety of switches, a mouse, a trackball, or a joystick, for example, can also be employed.

In addition, the foregoing embodiments have described that an embroidery sewing condition is specified by selecting buttons (for example, option buttons 110 and 120) displayed on a liquid crystal display 30 on a screen 100 for specifying an embroidery sewing condition. However, a condition specifying device is not limited thereto, and there may be employed other devices including a device for inputting the embroidery sewing condition in an input field, depending on a configuration of a display device or a specification device such as a touch panel and the embroidery sewing condition.

In addition, while in the foregoing embodiments, an embroidery pattern satisfying an embroidery sewing condition is displayed on a screen every time the pattern is extracted, the extracted embroidery pattern(s) may be displayed every time a predetermined amount of embroidery patterns have been through the determination whether they satisfy the embroidery sewing condition or not. Further, a method for displaying the extracted embroidery pattern is not limited to a mode of the foregoing embodiment. For example, a pattern indicating an embroidery sewing finish image of the extracted embroidery pattern may be displayed. In this case, an embroidery pattern can be selected after seeing an image of the extracted embroidery pattern. Further, for example, in the case where a plurality of extracted embroidery patterns exist, a priority may be defined according to a history or the like that shows the number of times the patterns were selected in the past, whereby the embroidery patterns extracted in accordance with the defined priority may be rearranged and displayed. In this manner, in the case where the embroidery patterns have been displayed after being rearranged to a certain order, convenience can be improved when a desired embroidery pattern is selected. For example, in the case of the second embodiment, an embroidery pattern with a smaller number of thread replacement may be displayed at the upper level of a list.

In addition, in the foregoing embodiments, a determination is made whether to satisfy an embroidery sewing condition for all of the embroidery patterns stored in the ROM 46. Alternatively, the determination may be made for only some of the embroidery patterns whether to meet the embroidery sewing condition. For example, in the case where the embroidery patterns are classified into a plurality of categories on a feature by feature basis, such as a character pattern, an animal pattern or a plant pattern, a category of an embroidery pattern may be specified. A determination may be made for only the embroidery patterns classified in that category that meet the embroidery sewing condition. According to this condition, the embroidery patterns satisfying the condition can be obtained from among the patterns classified in a desired category, thus further improving convenience in selecting any of the embroidery patterns. Furthermore, in the case where a predetermined number of embroidery patterns satisfying the condition have been extracted, a process may be canceled.

In the first embodiment, a pattern is extracted as an embroidery pattern that satisfies the sewing condition if each item of the embroidery thread information is coincident with any item of the needle bar thread information that serves as specified thread information. However, a pattern may be extracted if only some items of the embroidery thread information are coincident with the specified thread information. In accordance with this condition, an embroidery pattern may be extracted if the embroidery thread information is coincident with at least one item of the specified thread information. For example, a demand for extracting an embroidery pattern using a thread of at least one of the thread colors such as red, yellow, and orange, can be met. In addition, an embroidery pattern may be extracted as having embroidery thread information that is coincident with all items of the specified thread information. In accordance with this condition, for example, a demand for extracting an embroidery pattern that is to be sewn with all the threads of three types of thread colors such as red, yellow and orange, can be met.

Any device for calculating the thread replacement count can be employed as long as it can calculate a thread replacement count without being limited to an aspect of the second embodiment. For example, while in the second embodiment a predetermined thread information storage area (not shown) is configured so that the predetermined thread information can be stored by a number equal to that of the needle bars N, the calculated thread replacement count J calculated by using an arbitrary value equal to or smaller than the number of needle bars N may be compared with the specified thread replacement count P. In this case, as the stored number in the predetermined thread information storage area is closer to the number of needle bars N, a more efficient calculated thread replacement count J can be obtained, assuming an efficient thread replacement in view of thread information on the threads to be used previously or later. For example, the calculated thread replacement count J may be calculated while comparing the embroidery thread information and the needle bar thread information read out by a predetermined number such as the number of needle bars N. In this case as well, as the stored number to be read out is closer to the number of needle bars N, a more efficient calculated thread replacement count J can be obtained, assuming an efficient thread replacement in view of thread information on the threads to be used previously or later.

What is claimed is:

1. An embroidery data processing apparatus comprising:

an embroidery data storage device that stores embroidery data on a plurality of embroidery patterns to be sewn by a sewing machine;

a condition specification device that specifies an embroidery sewing condition for sewing an embroidery pattern; and an embroidery pattern extraction device that compares the embroidery data of the plurality of embroidery patterns stored in the embroidery data storage device with the embroidery sewing condition specified by the condition specification device and that extracts an embroidery pattern having embroidery data satisfying the specified embroidery sewing condition from among the plurality of embroidery patterns.

2. The embroidery data processing apparatus as claimed in claim 1, wherein:

the condition specification device specifies at least thread information as the embroidery sewing condition; and the embroidery pattern extraction device compares embroidery thread information with the specified thread information and extracts an embroidery pattern having embroidery data in which the embroidery thread information is coincident with the specified thread information, the embroidery thread information being thread information included in the embroidery data stored in the embroidery data storage device.

3. The embroidery data processing apparatus as claimed in claim 2, further comprising:

an analogous thread information acquisition device that acquires analogous thread information, the analogous thread information being thread information analogous to the specified thread information, wherein the embroidery pattern extraction device compares the embroidery thread information included in the embroidery data stored in the embroidery data storage device with the specified thread information and with the analogous thread information, and extracts an embroidery pattern having embroidery data in which the embroidery thread information is coincident with the specified thread information or with the analogous thread information.

4. The embroidery data processing apparatus as claimed in claim 2, wherein:

the specified thread information includes at least needle bar thread information on thread disposed in the sewing machine.

5. The embroidery data processing apparatus as claimed in claim 2, wherein:

the thread information includes at least thread color information.

6. The embroidery data processing apparatus as claimed in claim 1, further comprising:

a thread replacement count calculation device that compares embroidery thread information with needle bar thread information and that calculates a thread replacement count during embroidery sewing in accordance with the embroidery data, the embroidery thread information being thread information included in the embroidery data stored in the embroidery data storage device, and the needle bar thread information being thread information on thread disposed in the sewing machine, wherein the condition specification device specifies at least a thread replacement count for sewing the embroidery pattern by the sewing machine as the embroidery sewing condition, and the embroidery pattern extraction device compares a calculated thread replacement count with the specified thread replacement count and extracts an embroidery pattern for which the calculated thread replacement count is equal to or smaller than the specified thread replacement count.

7. The embroidery data processing apparatus as claimed in claim 1, further comprising:

a display device that displays the extracted embroidery pattern.

8. An embroidery data processing program recorded on a computer-readable recording medium, said program comprising instructions that cause a controller to perform:

an embroidery data acquisition step of acquiring embroidery data on a plurality of embroidery patterns to be sewn by a sewing machine;

a condition acquisition step of acquiring an embroidery sewing condition for sewing an embroidery pattern; and an embroidery pattern extraction step of comparing the embroidery data of the plurality of embroidery patterns acquired in the embroidery data acquisition step with the embroidery sewing condition acquired in the condition acquisition step and extracting an embroidery pattern having embroidery data that satisfies the embroidery sewing condition from among the plurality of embroidery patterns.

9. The embroidery data processing program as claimed in claim 8, wherein the condition acquisition step acquires at least thread information as the embroidery sewing condition, and the embroidery pattern extraction step compares embroidery thread information with specified thread information and extracts an embroidery pattern having embroidery data in which the embroidery thread information is coincident with the specified thread information, the embroidery thread information being thread information included in the embroidery data acquired in the embroidery data acquisition step, and the specified thread information being thread information acquired in the condition acquisition step.

10. The embroidery data processing program as claimed in claim 9, wherein the program further comprises instructions that cause a controller to perform:

an analogous thread information acquisition step of acquiring analogous thread information, the analogous thread information being analogous to the specified thread information, wherein the embroidery pattern extraction step compares the embroidery thread information included in the embroidery data with the specified thread information and with the analogous thread information, and extracts an embroidery pattern having embroidery data in which the embroidery thread information is coincident with the specified thread information or with the analogous thread information.

11. The embroidery data processing program as claimed in claim 9, wherein:

the specified thread information includes at least needle bar thread information on thread disposed in the sewing machine.

12. The embroidery data processing program as claimed in claim 9, wherein:

the thread information includes at least thread color information.

13. The embroidery data processing program as claimed in claim 8, wherein the program further comprises instructions that cause a controller to perform:

a thread replacement count calculation step of comparing embroidery thread information with needle bar thread information and calculating a thread replacement count during embroidery sewing in accordance with the embroidery data, the embroidery thread information being thread information included in the embroidery data, and the needle bar thread information being thread information on thread disposed in the sewing machine, wherein the condition acquisition step acquires at least a specified thread replacement count for sewing the embroidery pattern by the sewing machine as the embroidery sewing condition, and wherein the embroidery pattern extraction step compares a calculated thread replacement count with the specified thread replacement count and extracts an embroidery pattern for which the calculated thread replacement count is equal to or smaller than the specified thread replacement count.

14. The embroidery data processing program as claimed in claim 8, wherein the program further comprises instructions that cause a controller to perform:

a display step of displaying the extracted embroidery pattern.

15. A sewing machine comprising:

an embroidery data storage device that stores embroidery data on a plurality of embroidery patterns to be sewn;

a condition specification device that specifies an embroidery sewing condition for sewing an embroidery pattern; and an embroidery pattern extraction device that compares the embroidery data of the plurality of embroidery patterns stored in the embroidery data storage device with the embroidery sewing condition specified by the condition specification device and that extracts an embroidery pattern having embroidery data satisfying the embroidery sewing condition from among the plurality of embroidery patterns.

16. The sewing machine as claimed in claim 15, wherein:

the condition specification device specifies at least thread information as the embroidery sewing condition, and the embroidery pattern extraction device compares embroidery thread information with the specified thread information and extracts an embroidery pattern having embroidery data in which the embroidery thread information is coincident with the specified thread information, the embroidery thread information being thread information included in the embroidery data stored in the embroidery data storage device.

17. The sewing machine as claimed in claim 16, further comprising:

an analogous thread information acquisition device that acquires analogous thread information, the analogous thread information being analogous to the specified thread information, wherein the embroidery pattern extraction device compares the embroidery thread information included in the embroidery data stored in the embroidery data storage device with the specified thread information and with the analogous thread information, and extracts an embroidery pattern having embroidery data in which the embroidery thread information is coincident with the specified thread information or with the analogous thread information.

18. The sewing machine as claimed in claim 16, wherein:

the specified thread information includes at least needle bar thread information on thread disposed in the sewing machine.

19. The sewing machine as claimed in claim 16, wherein:

the thread information includes at least thread color information.

20. The sewing machine as claimed in claim 15, further comprising:

a thread replacement count calculation device that compares embroidery thread information with needle bar thread information and that calculates a thread replacement count during embroidery sewing in accordance with the embroidery data, the embroidery thread information being thread information included in the embroidery data stored in the embroidery data storage device, and the needle bar thread information being thread information on thread disposed in the sewing machine, wherein the condition specification device specifies at least a thread replacement count for sewing the embroidery pattern by the sewing machine as the embroidery sewing condition, and the embroidery pattern extraction device compares a calculated thread replacement count with the specified thread replacement count and extracts an embroidery pattern for which the calculated thread replacement count is equal to or smaller than the specified thread replacement count.

21. The sewing machine as claimed in claim 15, further comprising:

a display device that displays the extracted embroidery pattern.

* * * * *